US011668093B2

(12) United States Patent
Cooper et al.

(10) Patent No.: US 11,668,093 B2
(45) Date of Patent: Jun. 6, 2023

(54) LINTEL SUPPORT, MASONRY SUPPORT KIT, AND LINTEL SUPPORT METHOD

(71) Applicants: Clinton Scott Cooper, Germantown, TN (US); Clayton Edward Cooper, Gallatin, TN (US)

(72) Inventors: Clinton Scott Cooper, Germantown, TN (US); Clayton Edward Cooper, Gallatin, TN (US)

( * ) Notice: Subject to any disclaimer, the term of this patent is extended or adjusted under 35 U.S.C. 154(b) by 0 days.

(21) Appl. No.: 17/337,684

(22) Filed: Jun. 3, 2021

(65) Prior Publication Data

US 2022/0389713 A1 Dec. 8, 2022

(51) Int. Cl.

| | |
|---|---|
| ***E04C 3/08*** | (2006.01) |
| *E04C 3/04* | (2006.01) |
| *E04C 3/02* | (2006.01) |

(52) U.S. Cl.

CPC ..... *E04C 3/08* (2013.01); *E04C 2003/023* (2013.01); *E04C 2003/0413* (2013.01); *E04C 2003/0443* (2013.01)

(58) Field of Classification Search

CPC ..... E04C 3/08; E04C 2003/023; E04C 2003/0413; E04C 2003/0443; E04B 1/2612; E04B 1/2608; E04B 1/2604; E04B 1/4107; E04B 1/4142; E04B 1/4178

USPC ..... 52/702, 712, 715, 699, 701; 248/247, 248/248, 357

See application file for complete search history.

(56) References Cited

U.S. PATENT DOCUMENTS 537,505 A * 4/1895 Van Dorn ..... B21D 53/00 29/897.3
546,147 A * 9/1895 Gregg ..... F16B 9/05 182/87
598,135 A * 2/1898 Butz ..... E04B 1/2612 403/232.1
753,053 A * 2/1904 Eberhardt ..... F16B 7/0446 52/702
770,050 A * 9/1904 Dreyer ..... F16B 7/0446 248/300
783,807 A * 2/1905 Tuteur ..... E04B 1/2612 403/232.1
804,451 A * 11/1905 Carlson ..... E04B 1/2612 52/702
1,681,286 A * 8/1928 Fasshauer ..... E04C 3/02 52/204.2
1,765,107 A * 6/1930 Snyder ..... B65D 25/02 428/595
2,227,570 A * 1/1941 Burson ..... E04B 2/58 52/489.1

(Continued)

*Primary Examiner* — Brian E Glessner
*Assistant Examiner* — Adam G Barlow
(74) *Attorney, Agent, or Firm* — Catherine Napjus; Michael Persson; Chisholm, Persson & Ball, PC

(57) ABSTRACT

The present invention includes a lintel support to aid in lintel repair and/or reinforcement. The lintel support has a body with a top, a bottom, and a height extending therebetween; at least one claw at the top; and a bracket at the bottom. In use, points are dug out of a mortar line above the lintel and the claws of the lintel support are positioned into those points. With the claws so positioned, the bracket will be below the failing lintel. A support beam is placed under the bracket and a jack lift provides uplift at the mortar line where the claws are positioned.

23 Claims, 6 Drawing Sheets

(56) References Cited

U.S. PATENT DOCUMENTS 3,152,671 A * 10/1964 Mallory, Jr. ..... E01D 6/00 52/693
3,256,030 A * 6/1966 Banse ..... E04B 1/2608 52/712
3,633,950 A * 1/1972 Gilb ..... E04B 5/12 403/384
3,752,512 A * 8/1973 Gilb ..... E04B 1/2608 403/232.1
3,778,952 A * 12/1973 Soucy ..... E04B 2/763 52/696
4,124,962 A * 11/1978 Lancelot, III ..... E04B 1/2612 52/702
4,280,308 A * 7/1981 Svensson ..... E04C 3/02 52/98
4,348,002 A * 9/1982 Eyden ..... E04G 17/16 249/19
4,480,941 A * 11/1984 Gilb ..... E04B 1/2612 248/216.1
4,560,301 A * 12/1985 Gilb ..... F16B 9/052 403/3
4,805,315 A * 2/1989 Nesbitt ..... B25B 5/145 52/657
D308,805 S * 6/1990 Licht ..... 294/50.8
5,465,538 A * 11/1995 Powers, Jr. ..... E04B 1/703 52/432
5,687,556 A * 11/1997 Lintz ..... A01D 7/00 56/400.01
D395,928 S * 7/1998 Freelander ..... D30/162
D400,986 S * 11/1998 Kanta ..... D25/199
6,393,794 B1 * 5/2002 Pellock ..... E04C 3/02 52/696
6,415,575 B1 * 7/2002 Thompson ..... E04B 1/2608 52/715
7,347,469 B1 * 3/2008 Renganathan ..... A01B 1/00 294/25
7,634,879 B2 * 12/2009 Trotter ..... E04C 3/02 52/204.2
8,667,765 B1 * 3/2014 McCarthy ..... E04F 13/0828 52/745.1
8,677,718 B2 * 3/2014 Marshall ..... E04D 3/3608 52/713
8,769,887 B2 * 7/2014 Proffitt, Jr. ..... E04B 2/58 52/696
8,833,030 B2 * 9/2014 Zimmerman ..... E04B 1/2608 248/300
8,979,043 B2 * 3/2015 Florman ..... B23P 19/00 248/248
9,003,738 B1 * 4/2015 Evans, Jr. ..... E04C 3/02 52/702
9,151,058 B1 * 10/2015 Leathe ..... E04B 1/003
D760,578 S * 7/2016 Sigona ..... D8/349
D878,095 S * 3/2020 Dunahay ..... D6/553
D901,722 S * 11/2020 Helms ..... D25/119
11,053,680 B1 * 7/2021 McGee ..... E04C 3/32
11,118,349 B2 * 9/2021 Montoya ..... E04B 7/06
11,391,038 B2 * 7/2022 LeBlang ..... E04B 1/2604
2002/0092259 A1 * 7/2002 Crawford ..... E04C 3/02 52/696
2002/0184850 A1 * 12/2002 Kamenomostski ..... E04C 3/30 52/800.1
2004/0096269 A1 * 5/2004 Shahnazarian ..... E04B 1/2612 403/230
2004/0163355 A1 * 8/2004 Collie ..... E04B 7/045 52/702
2005/0072099 A1 * 4/2005 Roesset ..... E04C 3/12 52/633
2005/0284045 A1 * 12/2005 Smith ..... E04B 1/7046 52/204.2
2006/0260259 A1 * 11/2006 Morse ..... E04B 1/2608 52/698
2008/0216423 A1 * 9/2008 Trotter ..... E04C 3/02 52/204.2
2008/0282635 A1 * 11/2008 Robinson ..... E04C 3/02 52/410
2009/0308016 A1 * 12/2009 Strickland ..... E04C 3/08 52/690
2011/0146201 A1 * 6/2011 Vanker ..... E04B 1/1903 52/634
2014/0372082 A1 * 12/2014 Kamenomostskiy ... G06F 30/13 703/1
2016/0102456 A1 * 4/2016 Dietzen ..... E04C 3/08 52/693
2017/0298612 A1 * 10/2017 Hildestad ..... E04D 12/008
2018/0100307 A1 * 4/2018 Montminy ..... E04C 3/07
2018/0355602 A1 * 12/2018 Evans ..... E04B 1/2612
2019/0376275 A1 * 12/2019 Evans ..... E04C 3/292
2020/0299963 A1 * 9/2020 Golledge ..... E04C 3/06
2021/0230870 A1 * 7/2021 Montoya ..... E04B 1/40

* cited by examiner

LINTEL SUPPORT, MASONRY SUPPORT KIT, AND LINTEL SUPPORT METHOD

FIELD OF THE INVENTION

The present invention relates generally to masonry repair and reinforcement, and specifically to a device and improved method for lintel repair and reinforcement.

BACKGROUND

Lintels are common supports used in the field of masonry. Generally, lintels are beams set above doors and windows. They aid in transferring the wall load away from the window or door beneath and into the surrounding wall. Lintels have been in use for centuries. Older lintels are typically made of stone, brick, or wood. Modern lintels may be made of such natural materials, but may also be made of manmade materials, particularly prefabricated steel or reinforced concrete. An improperly installed lintel or simply an aging lintel may fail. Lintel failure may result in substantial property damage, such as collapsed walls, windows, or doors. Such failure also obviously poses a safety hazard for people in or around the building during failure.

In the past, the only way to address a failing lintel was quite labor intensive: remove all of the bricks, stone, or lumber from above the lintel; replace or repair the lintel; and then replace all of the bricks, stone, or lumber. In many cases, this would amount to practically rebuilding the structure. There have been at least two major advances in addressing lintel failure that avoid such extreme measures.

The first is disclosed in U.S. Pat. No. 7,634,879 to Trotter. Trotter discloses a reinforcement system to reinforce an elongated load bearing member having opposing ends and supporting a load. The reinforcement system comprises an elongated reinforcing member having a first portion disposed beneath the load bearing member between the opposing ends of the load supporting member and having a length substantially equal to the length of the load bearing member; and the elongated reinforcing member having a second portion having a length greater than the first portion, the second portion extending substantially normal from the first portion and spaced apart from the load bearing member, the second portion adapted to be securedly fixed in a substantially static position to support the first portion disposed beneath the load bearing member. Essentially, Trotter's elongated reinforcing member supports the failing lintel from beneath. A similar system is marketed under the trademark LINTEL LIFT owned by Kennedy and Sons Structural Solutions. While these systems do reinforce the failing lintel without the need to tear down and then rebuild the structure, they also have their disadvantages. Most importantly, the reinforcing beams must all be within the opening already defined by the existing lintel; thus reducing that opening significantly on at least three sides. If such a system were used with a garage, for example, a larger vehicle may no longer fit in the opening at all, but even with smaller vehicles, additional care would be needed when moving the vehicle through the smaller opening to avoid vehicle damage, especially scraping of the sides of the vehicle. There also may be aesthetic disadvantages. The additional supports may ruin the look of the opening and will certainly add clutter and additional materials to the space.

The second advance in addressing lintel failure is through the use of helical embedment bars. These were developed decades ago but are still sold under trademarks such as THOR HELICAL and TWISTFIX. The helical embedment bars may be used more generally to address any cracks in brickwork or masonry, whether the cause is lintel failure or not. First, old grout is removed from at least one mortar line to provide a space for the bars. Then, at least one and preferably two stainless steel helical re-bars are embedded into the space with masonry repair grout. The masonry repair grout bonds the helical bars into place. It is high performance adhesive grout, such as that sold under the trademark WHO-60. The use of helical bars has neither of the disadvantages of the system described above. Namely, it neither reduces the usable space, nor affects the aesthetics. While its longevity in the market, if nothing else, speaks to its utility, improvements may be made upon this method of repair.

SUMMARY OF THE INVENTION

The present invention is a lintel support, a masonry support kit including at least one lintel support, and a method for supporting damaged or failing lintels using the masonry support kit.

In its most basic form, the masonry support kit of the present invention includes at least one lintel support. The lintel support has a body with a top, a bottom, and a height extending therebetween. The body includes a claw side and a non-claw side. At least one claw extends perpendicularly from the top of the claw side of the body and a bracket extends perpendicularly from the bottom of the body. There are preferably three claws, with the center claw positioned directly over the bracket and right and left claws on either side, with spaces between each of the claws.

In use, as is described below with respect to the method of the present invention, points would be dug out of a mortar line above the failing lintel and the claws of the lintel support would be positioned into those points. With the claws so positioned, the bracket will be below the failing lintel. A support beam would then be placed under the bracket of the lintel support and a jack lift would be used to provide uplift at the mortar line where the claws are positioned. This allows for repair, reinforcement, and/or replacement of the lintel, as discussed below.

Although one, two, or four or more claws may be included in the lintel support, the preferred three claws encourages a more even weight distribution across a longer length of the failing lintel. This minimizes the chance of a single focused uplift load point that might create new fissures. Moreover, having three claws allows support on either side of the center claw that is directly above the upright area, so that energy is transferred straight up. Four claws would not allow for this direct uplift. Rather than the preferred three claws, another option that would stimulate the desired direct uplift would be a single, wider claw. This is also not preferred, however, because the single solid claw would obscure the bricks behind the lintel support and instead of three relatively small points being dug out of the mortar line, a larger linear section of mortar would require removal.

The lintel support is preferably made of steel. Specifically, the lintel support is preferably made of a flat steel plate that is professionally bent or welded so as to achieve the required weight and load dispersal. The flat steel plate is preferable ¾" thick so as to minimize the weight of the lintel support while not compromising its strength. The preferred steel lintel support provides protection against deformation below 1800 lbs. of force on the lintel support. While field tests have shown that less than a few hundred pounds of force is necessary to achieve upward movement, the excessive robustness is preferred to accommodate repeated stress loads applied hundreds of times a year across multiple jobs.

The height of the body is preferably between 15 and 20 inches. This allows ample room for the bracket to be below the lintel, but for the claw(s) to be positioned at least two courses of standard sized bricks above the lintel. Various heights may be employed, however, as some structures, such as those with stones of non-standard sizes above the lintel, may require a shorter or longer lintel support body. Whatever the height though, the material must be such that the body can withstand the pressure that will be displaced onto the body of the lintel support without deflection or other deformation of the body. As such, very long body heights may be difficult to construct. The body may include means to adjust the height, but again the adjustment means cannot compromise the integrity of the lintel lift when supporting load. It is understood that the dimensions included herein are preferred but merely exemplary. A larger lintel support may become unwieldy as far as weight and portability. A smaller lintel support would provide less support. As noted above, however, the preferred lintel support is designed for forces well in excess of the forces that are practically encountered. As such, a fairly significant size reduction would not necessarily affect the lintel support's utility.

It is preferred that the claw(s) and the bracket extend perpendicularly away from the body in the same direction from the claw side of the body. In some embodiments, however, the bracket may extend perpendicularly away from the body on both the claw and non-claw sides. The bracket and the claw(s) may also extend perpendicularly away from the body in opposite directions, but this is not preferred. The bracket preferably includes bracket right and left sides, each of which includes a bracket support extending between the bracket right and left sides and the body of the lintel support. These bracket supports may be small beams, but are preferably triangular shaped plates integrated on one side to the body and on another side to the bracket sides.

The preferred lintel support includes a number of reinforcements. When the lintel support includes only one claw, the lintel support includes a claw reinforcement extending substantially between the bottom of the body and the one claw at the top of the body. As used herein "extending substantially" means that the claw reinforcement extends through at least 80% of the height of the body. When the lintel support includes three claws, as is preferred, the lintel support preferably includes a center claw reinforcement, as described above with reference to the embodiment including only one claw, as well as right and left claw reinforcements that extend from the center claw reinforcement on either side to the right and left claws, respectively. It is preferred that any claw reinforcements be disposed on the non-claw side of the body. It is understood that some materials and/or dimensions of the various embodiments of the lintel support do not require such claw reinforcements. The reinforcements are preferably braces made of thin, sturdy material extending perpendicularly out from the non-claw side of the body.

The shape of the body of the preferred lintel support that includes three claws is roughly triangular. The bottom of the body, at the bracket, includes a bracket width. The top of the body, extending across all three claws, includes a claw width. The bracket width is less than the claw width. The body further includes a right angled side extending between the bracket and the right claw and a left angled side extending between the bracket and the left claw. As such, the body has a roughly triangular shape.

It is preferred that the body of the lintel support include at least two body holes. The body holes serve as handholds, making the lifting and placing of the lintel support easier. While convenient, the body holes may be omitted as they do not enhance the main function of the lintel support and may act as an undesirable deflection point in the design once the lintel support is under load.

Preferred embodiments of the masonry support kit include more than one lintel support. In such embodiments, it is preferred that the kit also include a spreader. The spreader includes a length, a depth, and a plurality of spreader holes spread along the length, where the spreader holes have a diameter that is less than the bracket width of any of the lintel supports. The spreader holes must have a diameter less than the bracket width so that the brackets will not fall into the spreader holes. The spreader is used to evenly and securely space more than one lintel support. The bracket of each lintel support preferably includes a bracket hole and the kit preferably further includes means for holding the bracket holes of the lintel supports in place relative to at least two of the spreader holes of the spreader. These means for holding may be any commonly used in the art, such as screws or pegs. The spreader must have a depth so that these screws are pegs may function to extend through both the bracket holes and the spreader holes. The spreader will be positioned between the lintel supports and the support beam. Rather than needing extra hands to make sure that each of the lintel supports stays in place as upward force is applied to the support beam, the spreader holds the lintel supports in place, so that the upward force may be applied directly under the spreader. If the spreader has sufficient strength, the spreader may be the support beam and the additional structure of the support beam may be eliminated.

Some embodiments of the kit of the present invention include the support beam and/or the jack lift. The support beam may be of any type commonly used in the art, such as a steel I-beam or square tube, so long as the support beam has a surface that may be disposed beneath the bracket. A 4" I-beam is preferred for its ability to transfer vertical forces with minimal deflection. The jack lift may be of any type commonly used in the art, but is preferably an electric hydraulic drive ram.

In its most basic form, the method for supporting masonry of the present invention includes the following steps: selecting at least one point in a first mortar line above a failing lintel; removing mortar from the at least one point in the first mortar line; setting at least one claw of at least one lintel support into the at least one point with removed mortar such that the bracket of the at least one lintel support is disposed below the failing lintel; disposing a support beam beneath the bracket of the lintel support; disposing a jack lift beneath the support beam; and applying upward pressure from the jack lift. It is understood that the terms grout and mortar may be used interchangeably herein.

The step of selecting at least one point in a first mortar line above a lintel usually involves selecting a mortar line that is not directly above the lintel. In this context "first" is not necessarily used to denote which mortar line above the lintel is selected, but rather to distinguish this first mortar line from second and third mortar lines, discussed below. The first mortar line may be the mortar line directly above the lintel. In most cases, however, the first mortar line is above two or three standard brick courses or the equivalent above the failing lintel. This allows a standard sized lintel support to have its claws at the first mortar line and its bracket below the lintel.

The mason will use her best judgement as to which mortar line should be the first mortar line and where the points should be within that first mortar line, considering the specific job. Considerations may include the nature and general state of the masonry materials and the nature and location of the damage to the lintel, as well as the size and other characteristics of the lintel support(s) she has at her disposal. Whether one or more points are selected depends on how many claws the lintel support includes. If the lintel support has only one claw, then only one point is selected. As discussed above, if only one claw is included and that one claw is wide, then the "point" may be a longer line. If the lintel support has two or more claws, then the same number of points will be selected and the distance between the points will correspond with the distance between the claws on the lintel support. If more than one lintel support is deployed, additional points will be selected as appropriate.

The step of removing mortar from the at least one point in the first mortar line involves scraping out the mortar at the point or points. The mortar should be dug out deep enough so that the entire claw may be set into the space created by removing the mortar. Appropriate safety measures, such as personal protection equipment and dust containment measures should be utilized during this step.

The next step is setting at least one claw of at least one lintel support into the at least one point with removed mortar such that the bracket of the at least one lintel support is disposed below the lintel. This step may be used with any of the embodiments of the lintel support, as described above. As noted above, the claws should be inserted as far into the points with the removed mortar as possible. In embodiments of the lintel support that include claw reinforcements, it is preferred that those claw reinforcements be included on the non-claw side of the body of the lintel support. This is so that the smooth claw side of the body may face the masonry wall, thereby getting as close to the wall as possible so that the claws may be inserted into the spaces as far as possible. The first mortar line must have been selected so that the lintel support's height is sufficient so that the bracket of the lintel support is disposed below the lintel in this step.

The next step is disposing a support beam beneath the bracket of the lintel support. In some embodiments of the method, the beam is supported and elevated on either side from the beginning, so that the beam is always fairly close to the bracket and the jack lift disposed under the center of the beam is used to carefully close the distance between the beam and the bracket. This is preferred so that the beam is already substantially in place before the jack lift is placed beneath the beam. In some embodiments, however, there are no supports on either side of the beam and the support and elevation depends solely on the jack lift. This set up may be a bit precarious, however, and is therefore not preferred.

The next step is disposing a jack lift beneath the support beam. The jack lift should be disposed substantially in the middle of the support beam. The last step is applying upward pressure from the jack lift. As the support beam is lifted from below by the jack lift, upward pressure is supplied to the claws of the lintel support. This will cause the load to shift from the failing lintel to the lintel support. It is preferred that the upward pressure be applied gradually, so that the mason may use her best judgement as to how much uplift is necessary for the repairs she plans and considering the state of the masonry wall about the lintel support. At this point, measures may be taken to repair, reinforce, and/or replace the lintel.

It is preferred that the method of the present invention also include the step of adding at least one shim above the failing lintel. The shim may be any shim commonly used in the art of masonry, but is preferably a ¼" flat black steel strap cut to length for space exposed during the lifting process. The size and substance of the shim may be selected based on the particular job. This step preferably includes the steps of removing grout from a third mortar line and then filling the space created by the grout removal with the at least one shim. The third mortar line is above the failing lintel, and must be below the first mortar line, so that it is in the section of the masonry wall that has been relieved of pressure by the lintel support. It is preferred that the shim be added directly above the failing lintel, i.e. that the third mortar line be the mortar line directly above the failing lintel. Some jobs may recommend placement of the shims in a mortar line higher than that directly above the failing lintel (but still below the first mortar line), however. Indeed, some jobs may recommend placement of shims in more than one mortar line above the failing lintel. In some embodiments, this step also includes the step of injecting caulk over the opening and in front of the shim. This step is essentially aesthetic, so as to hide the space created. The caulk is preferably of the type sold under the trademark NEXUS PRO CONCRETE JOINT SEALANT, but may be any commonly used in the art.

It is preferred that the method of the present invention also include steps for introducing at least one helical embedment bar. These steps may or may not be in conjunction with the steps to add shim(s). These steps include removing mortar from at least one second mortar line above the failing lintel, with the mortar removal extending on either side of the at least one lintel support; injecting masonry repair grout into a space created by the removed mortar from the at least one second mortar line; and inserting at least one helical embedment bar into the masonry repair grout. As it is preferred that two helical embedment bars be included, these steps preferably include removing mortar from at least one second mortar line above the failing lintel on either side of the at least one lintel support; injecting masonry repair grout into a space created by the removed mortar from the at least one second mortar line; inserting a first helical embedment bar into the masonry repair grout; injecting additional masonry repair grout; inserting a second helical embedment bar into the masonry repair grout; and injecting caulk. This final step of injecting caulk creates a blended look for aesthetic purposes. The caulk is preferably expansive silicate-based caulk. The use of two helical embedment bars is preferred to better distribute loads and to reinforce the opening to prevent future failure. It is preferred that the second mortar line be above the first mortar line, preferably two feet above the first mortar line. Two feet is a general guideline and not a set rule. The vertical difference is the important factor and, has been proven to work well, but may also be varied with success. In some embodiments, however, the first and second mortar lines may be the same or the second mortar line may be below the first mortar line. Such embodiments of the method are not preferred because the lintel supports themselves may get in the way of the application of the helical embedment bars, but it may be done.

The step of removing mortar from the second mortar line in this case involves removing mortar along a distance at least as long as the helical embedment bars. Again, appropriate safety measures should be employed during this grout removal. The space created for the helical embedment bars in the second mortar line should be centered on the uplift provided by the lintel support(s), which is why the mortar should be removed on either side of the at least one lintel support. Obviously, the center of the uplift will vary depending on how many lintel supports are deployed. The masonry repair grout is preferably that sold under the trademark WHO-60. The masonry repair grout may be injected by any means commonly used in the art, such as with a grout gun or by forcing the grout into the space with tools. It is preferred that two helical embedment bars be inserted.

As described above with respect to the kit of the present invention, for some jobs, it is preferred that at least two lintel supports be used in the execution of the method of the present invention. In such embodiments of the method, a spreader may be used and the method includes the following steps: attaching the brackets of the at least two lintel supports to a spreader; and disposing the spreader between the at least two lintel supports and the support beam. As described above, the attachment is preferably achieved by aligning the bracket holes of the brackets of the lintel supports with spreader holes disposed along the length of the spreader and then affixing the holes in place relative to one another by inserting a screw or peg through both holes.

Some embodiments of the method of the present invention further include the steps of removing the failing lintel and replacing the failing lintel with an undamaged lintel. Depending on the state of the masonry wall, such steps may not always be performable. If it is suspected that the grout in the masonry wall is weak or the wall is otherwise structurally unsound, it may be inadvisable to remove the failing lintel even if it is quickly replaced with an undamaged lintel. In circumstances where the mason has reason to trust the structural integrity of the masonry wall other than the failing lintel and the mason knows that sufficient pressure has been relieved from the failing lintel, then these steps may be performed.

These aspects of the present invention are not meant to be exclusive and other features, aspects, and advantages of the present invention will be readily apparent to those of ordinary skill in the art when read in conjunction with the following description accompanying drawings, and claims.

DETAILED DESCRIPTION

Figure 1B:
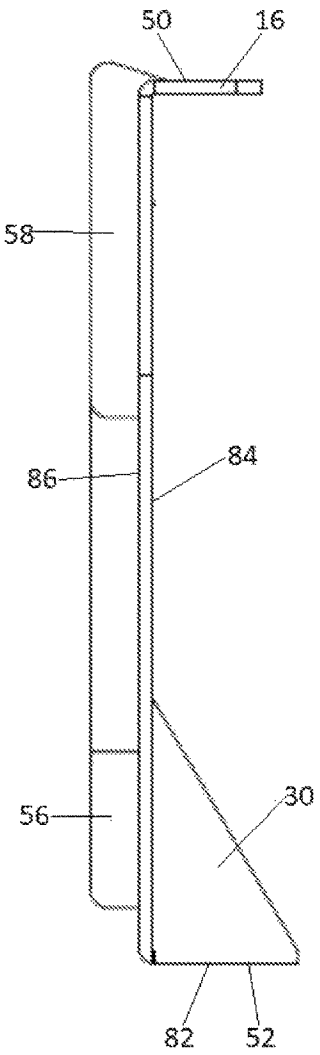
FIG. 1*b* is a right side view of the lintel support shown in FIG. 1*a*.
Figure 1A:
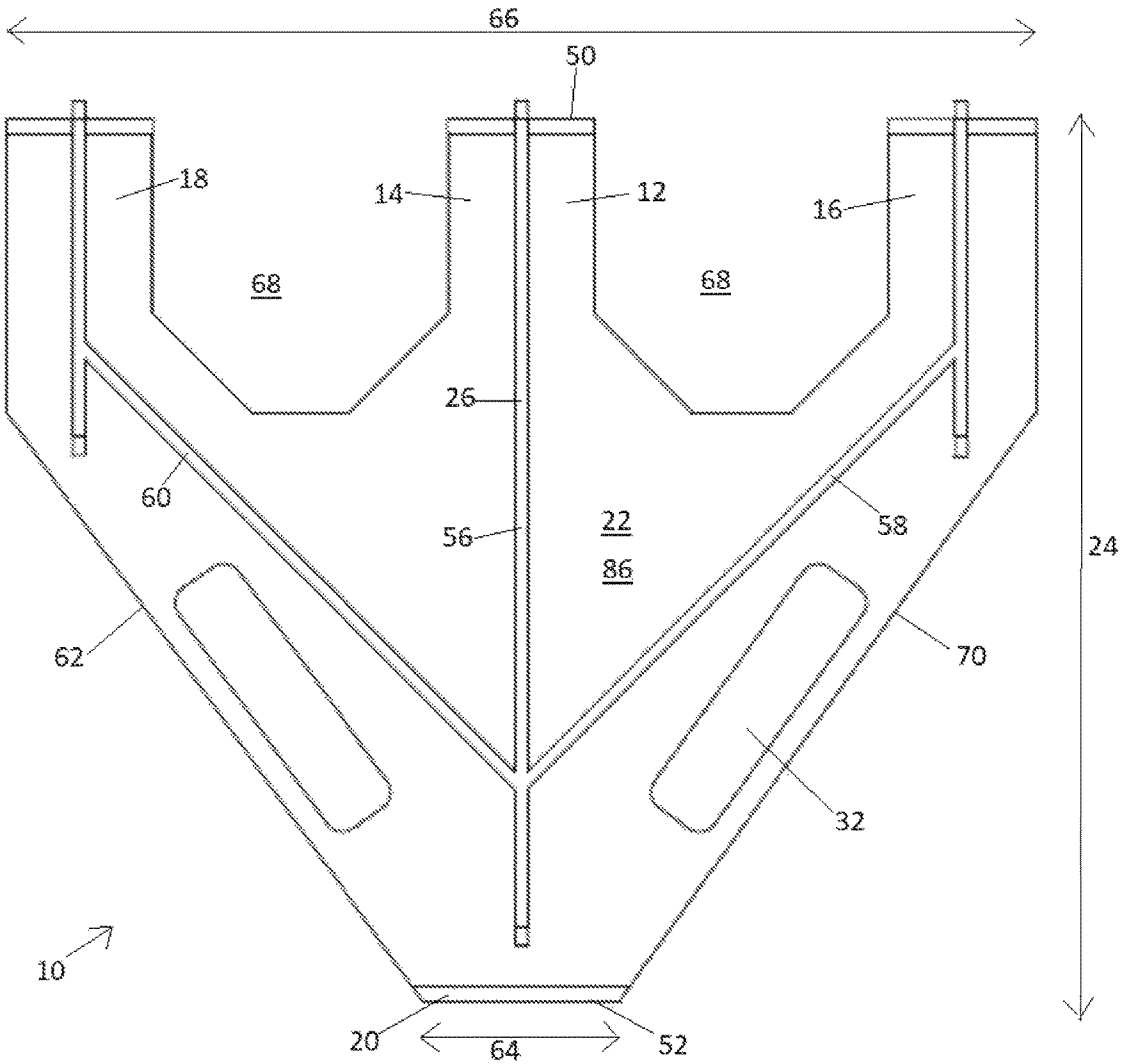
FIG. 1*a* is a front view of a preferred lintel support of the present invention showing the non-claw side of the lintel support body.

Referring first to FIGS. 1*a*-1*d*, various views of lintel support 10 are provided. Lintel support 10 includes body 22 with top 50 and bottom 52 and height 24 extending therebetween. Body 22 has smooth claw side 84, shown most clearly in FIG. 1*d*, and non-claw side 86 that may not be smooth due to the inclusion of claw reinforcements 26, as discussed below. Bottom 52 includes bracket 20, shown most clearly in FIG. 1*d*. Bracket 20 is a tab of material extending perpendicularly out from bottom 52 of body 22. Top 50 includes at least one claw 12. The preferred embodiment with three claws 12, center claw 14, right claw 16, and left claw 18, is shown.

Figure 1D:
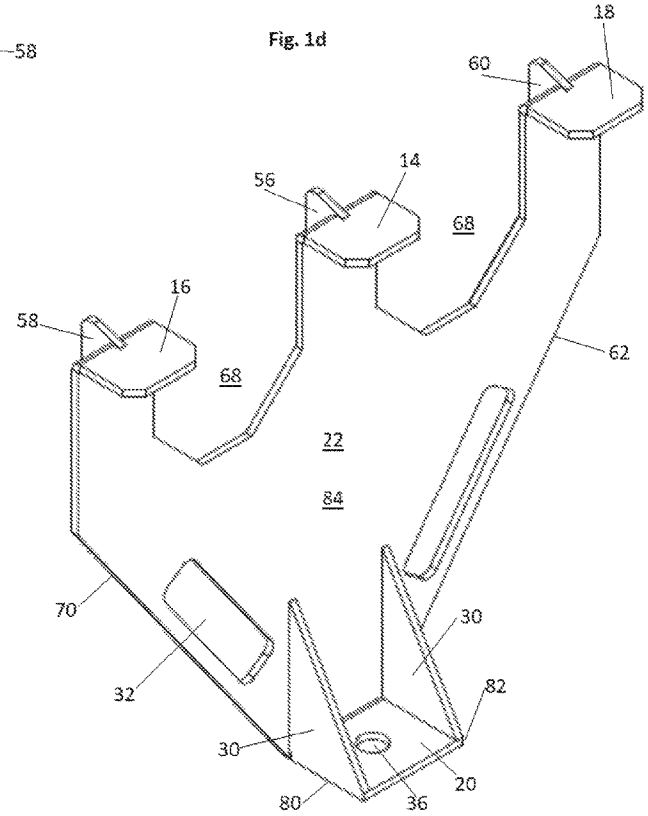
FIG. 1*d* is a perspective view of the claw side of the lintel support shown in FIG. 1*a*.
Figure 1C:
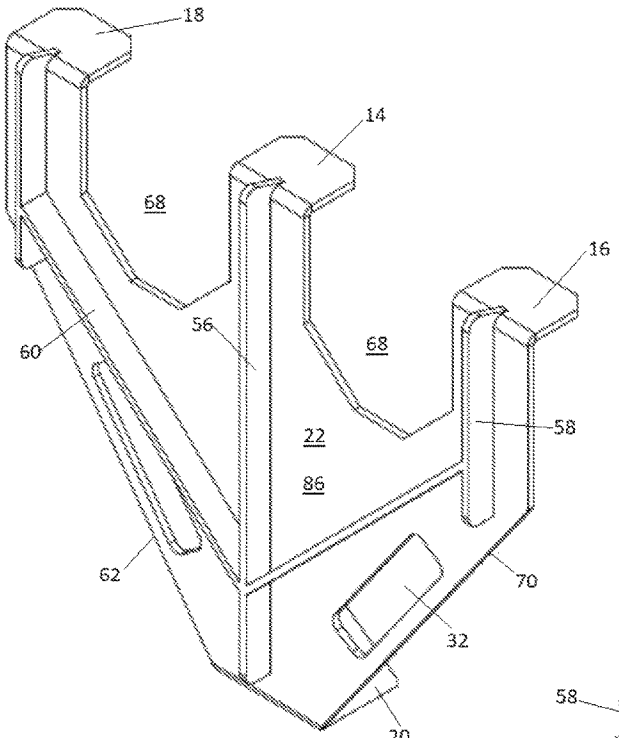
FIG. 1*c* is a perspective view of the non-claw side of the lintel support shown in FIG. 1*a*.

There are spaces 68 between left claw 18 and center claw 14 and between center claw 14 and right claw 16. Bottom 52 has bracket width 64, which is also the width of bracket 20. Top 50 has top width 66, which is the width across all claws 12. With right angled side 70, left angled side 62, and the fact that top width 66 is greater than bracket width 64, body 22 has a roughly triangular shape. Claws 14, 16, 18, as best shown in FIGS. 1*c* and 1*d*, are also tabs extending perpendicularly out from body 22. As is shown and preferred, claws 14, 16, 18 and bracket 20 each extend out perpendicularly from body 22 from claw side 84 of body 22. It is understood, however, that bracket 20 and claws 14, 16, 18 may extend out perpendicularly on both claw side 84 and non-claw side 86 of body 22 or that bracket 20 and claws 14, 16, 18 may extend out perpendicularly in opposite directions from body 22.

Bracket 20 includes bracket supports 30, which extend from bracket right and left sides 80, 82 to attach to body 22. Claws 12 also have claw reinforcements 26. Center claw reinforcement 56 extends substantially between center claw 14 and bottom 52 of body 22. Right and left claw reinforcements 58, 60 extend between center claw reinforcement 56 and right and left claws 16, 18, respectively. Claw reinforcements 26 are disposed on non-claw side 86 of body 22. Claw reinforcements 26, including center, right, and left claw reinforcements 56, 58, 60 are preferably sturdy, rigid braces that extend out perpendicularly from body 22 and protect against deflection of body 22 when lintel support 10 is in use. Body 22 also includes body holes 32 that are handholds and may be omitted. Bracket 20 includes bracket hole 36, which may be used in conjunction with a spreader 38, as discussed below with reference to FIG. 2.

Figure 2:
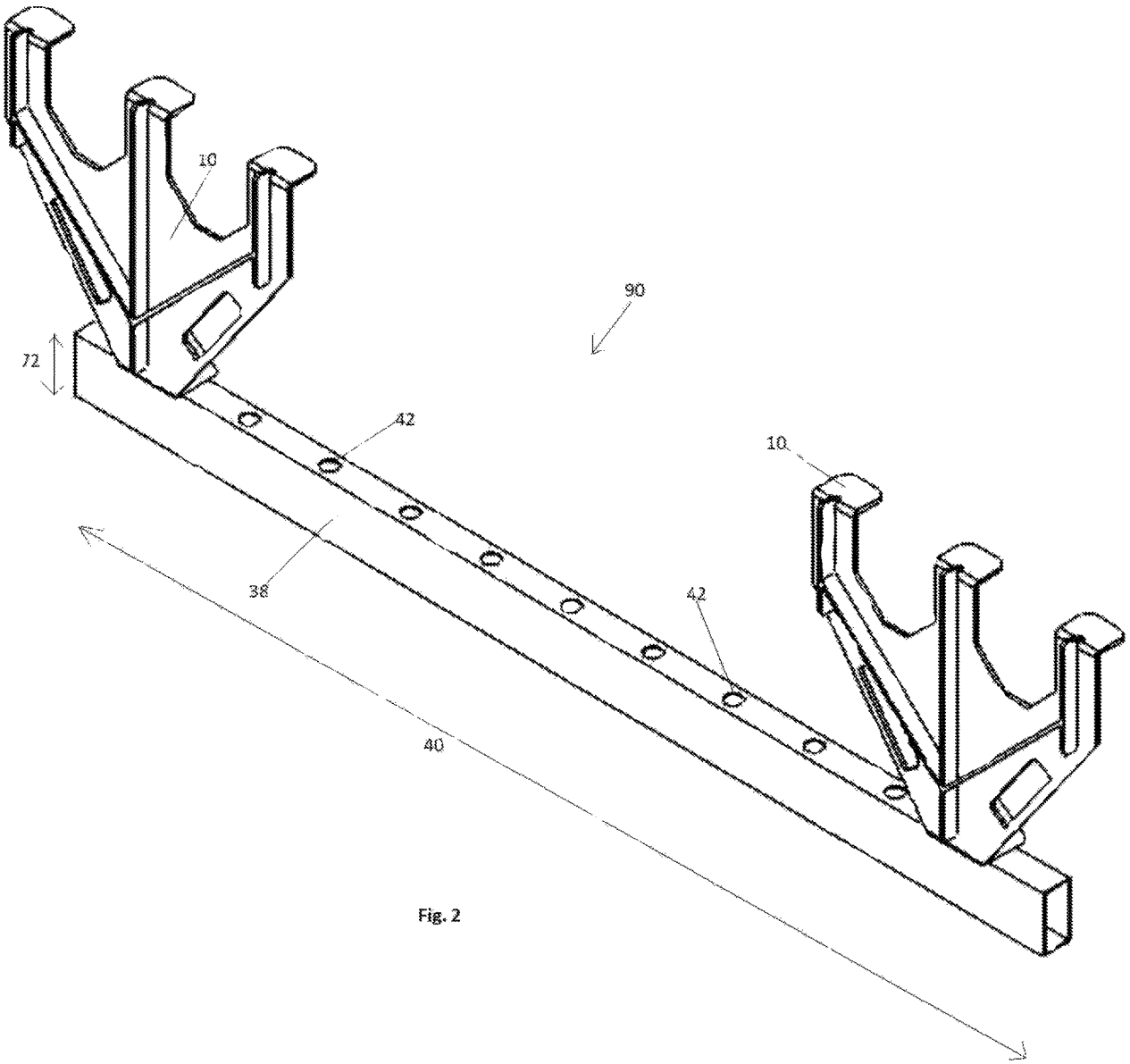
FIG. 2 is a perspective view of two lintel supports of the present invention in use with a spreader.

Now referring to FIG. 2, a perspective view of two lintel supports 10 positioned with spreader 38 is provided. Masonry support kit 90 includes at least one lintel support 10 and may also include spreader 38, especially when more than one lintel support 10 is included in kit 90, as shown in FIG. 2. Spreader 38 has spreader length 40, spreader depth 72, and several spreader holes 42 along spreader length 40. This kit 90 also includes means for holding the lintel supports' bracket holes 36 in place relative to spreader holes 42. These means are not visible in this view, but it is understood that the bracket holes 36 are aligned with the spreader holes 42 and means, such as a screw or peg, are utilized to maintain this alignment and position. Spreader 38 must include spreader depth 72 so that these means have room to extend through both the bracket holes 36 of the lintel supports 10 and the spreader holes 42 of the spreader 38.

Figure 3:
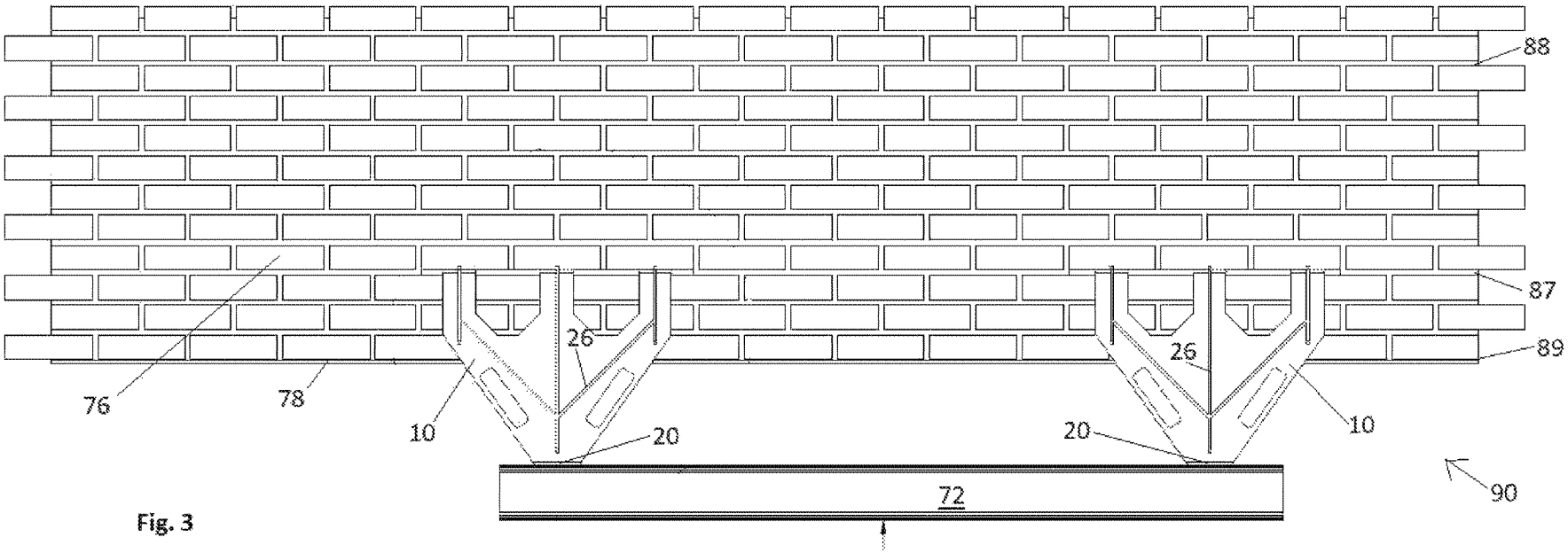
FIG. 3 is an illustration of two lintel supports of the present invention in use with a brick wall over a damaged lintel.

Now referring to FIG. 3, an illustration of a kit 90 of the present invention in use with a brick wall 76 and a failing lintel 78 is provided. Kit 90 may include support beam 72 and a jack lift (not shown). It is understood that a spreader 38 could be used in such an illustration and would be disposed between the lintel supports 10 and the support beam 72 if it were included, or alternatively that spreader 38 may be support beam 72. Claw reinforcements 26 face away from claws 12 and support body 22 from buckling when pressure is applied, as described below. First, second, and third mortar lines 87, 88, 89 are indicated, respectively, and discussed below with reference to method 100.

The mason has selected points in the first mortar line 87, which is three bricks up the brick wall 76; removed the old grout at those points; positioned claws 12 of lintel supports 10 in the spaces made with the removal of the grout at the points; positioned support beam 72 beneath brackets 20 of lintel supports 10 and provided uplift from the jack lift below the support beam 72. This removes substantial pressure from failing lintel 78. With that pressure relief, the mason may introduce shims and/or helical embedment bars, as discussed below with reference to method 100 of the present invention. In some circumstances, the mason may even completely remove the old failing lintel 78 and replace it. No prior art, other than complete deconstruction and reconstruction offers this option.

Figure 4A:
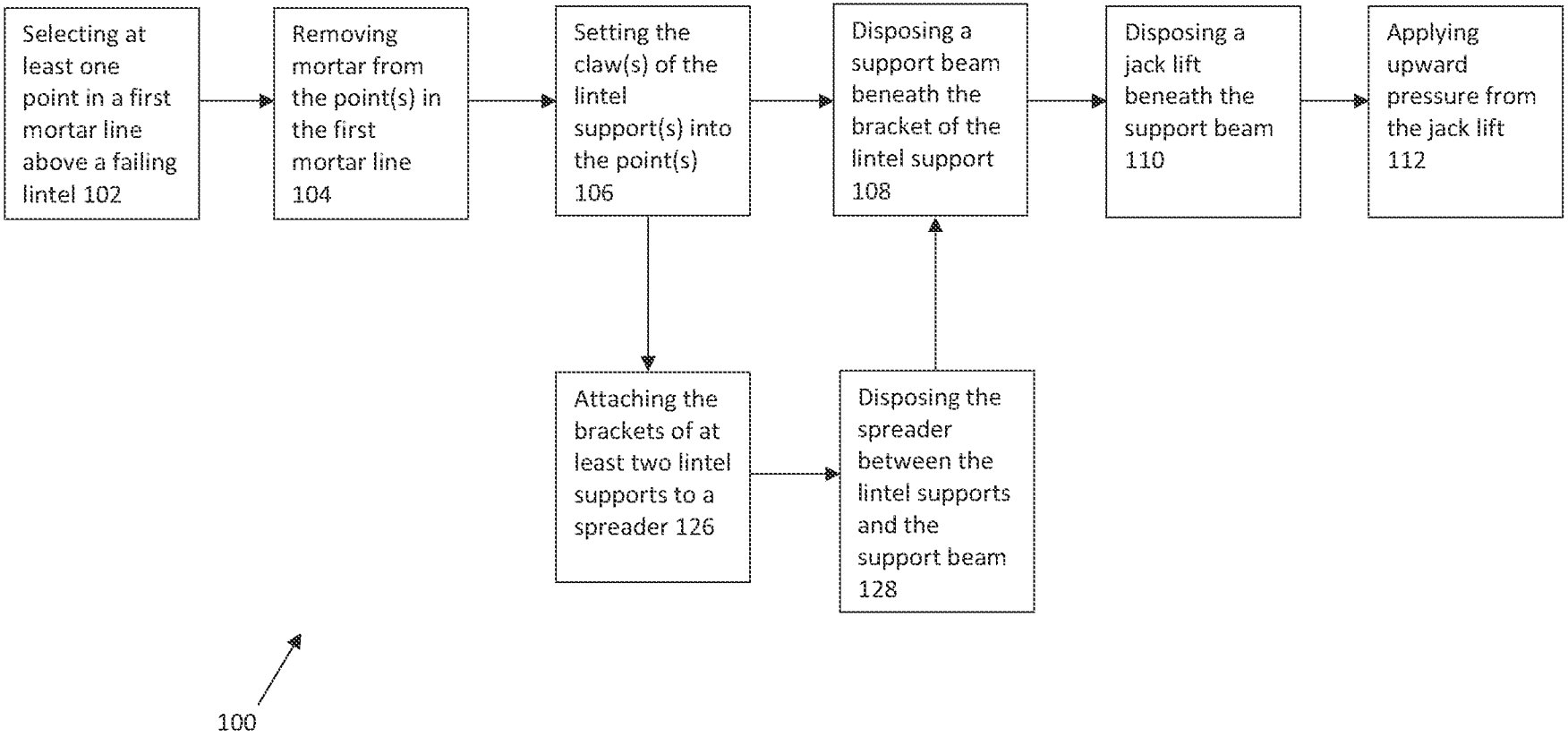
FIGS. 4*a* and 4*b* include a flow chart of the steps of the preferred method of the present invention.

Now referring to FIG. 4*a*, a flow chart illustrating the steps of method 100 of the present invention is provided. Across the top are the steps of method 100 in its most basic form: selecting at least one point in a first mortar line above a failing lintel 102; removing mortar from the point(s) in the first mortar line 104; setting the claw(s) of the lintel support (s) into the point(s) with removed mortar so that the bracket (s) of the lintel support(s) are disposed below the failing lintel 106; disposing a support beam beneath the bracket of the lintel support 108; disposing a jack lift beneath the support beam 110; and applying upward pressure from the jack lift 112. The steps of attaching the brackets of at least two lintel supports to a spreader 126 and disposing the spreader between the lintel supports and the support beam 128 may be included between steps 106 and 108.

Figure 4B:
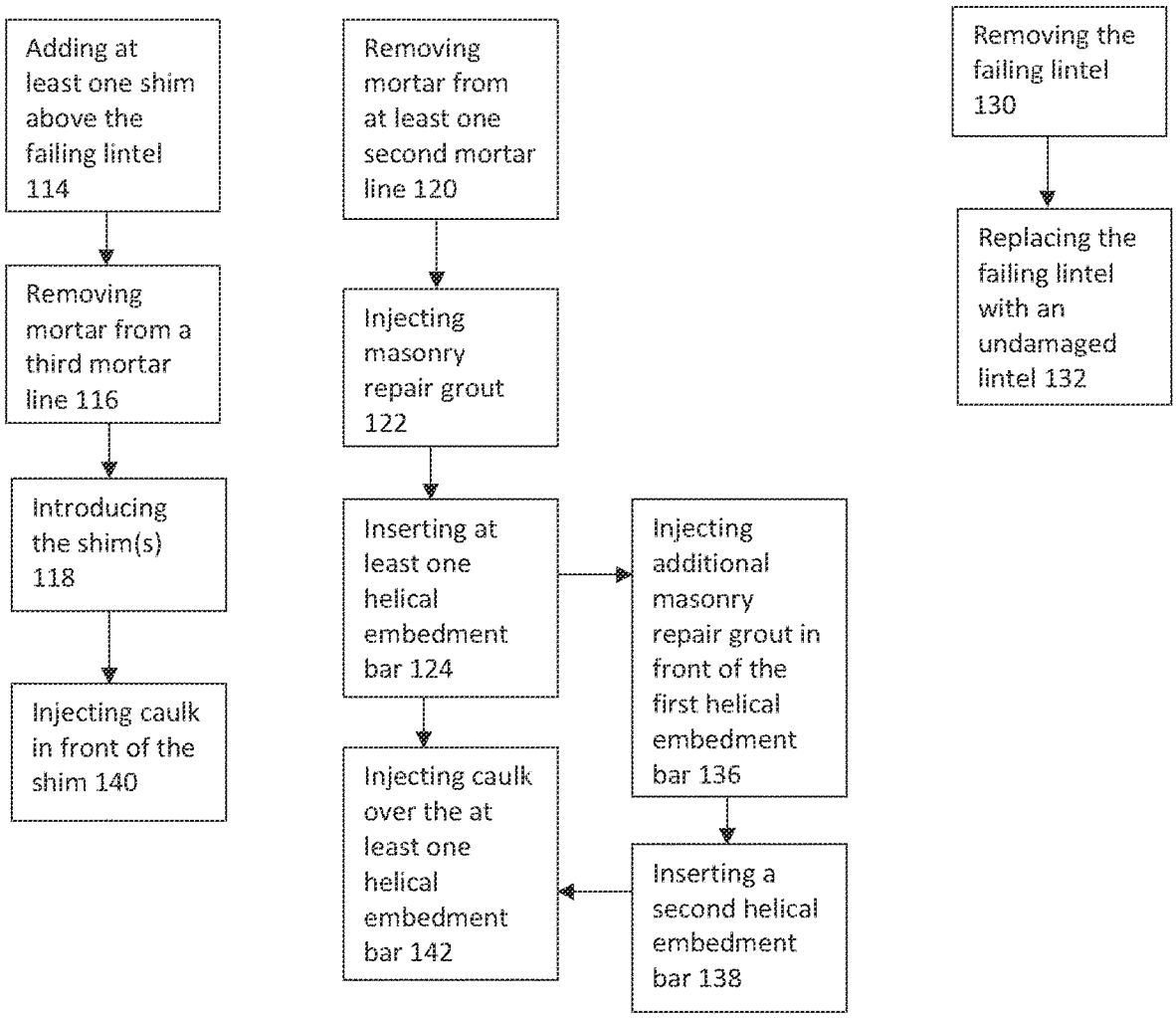

Now referring to FIG. 4*b*, additional optional steps of method 100 beyond its most basic form are provided. Method 100 may also include the step of adding at least one shim above the failing lintel 114, which includes the steps of removing mortar from a third mortar line 116; and introducing the shim(s) into the space created by the mortar removal from the third mortar line 118, where the third mortar line is above the failing lintel and below the first mortar line. It is preferred that the following additional step be performed after step 118 for the sake of aesthetics: injecting caulk in front of the shim 140.

Method 100 may also include the steps of removing mortar from at least one second mortar line above the failing lintel on either side of the at least one lintel support 120; injecting masonry repair grout into a space created by the removed mortar from the at least one second mortar line 122; and inserting at least one helical embedment bar into the masonry repair grout 124. It is preferred that the following additional step be performed after step 124 for the sake of aesthetics: injecting caulk over the at least one helical embedment bar 142. As it is preferred that two helical embedment bars are used, the steps may be: removing mortar from at least one second mortar line above the failing lintel on either side of the at least one lintel support 120; injecting masonry repair grout into a space created by the removed mortar from the at least one second mortar line 122; inserting a first helical embedment bar into the masonry repair grout 124; injecting additional masonry repair grout into the space in front of the first helical embedment bar 136; and inserting a second helical embedment bar 138. In some embodiments, more than one second mortar line may be selected for reinforcement with helical embedment bars. Field operations have shown that this may be preferred in situations that include a large number of failure points. As such, steps 120, 122, and 124 (and 136 and 138) may be repeated at a second second mortar line.

Method 100 may also include the steps of removing the failing lintel 130 and replacing the failing lintel with an undamaged lintel 132. Steps 126, 128; 114, 116, 118; 120, 122, 124; and 130, 132 are not mutually exclusive sets of steps but may all be performed or performed in combinations, in addition to the basic steps that method 100 always includes—102, 104, 106, 108, 110, and 112. While steps 130 and 132 cannot be performed without steps 102, 104, 106, 108, 110, and 112 having been performed, steps 114, 116, and 118 may occur before, during, or after these steps, but preferably after. Similarly, steps 120, 122, and 124 may occur before, during or after these steps, but preferably after.

Referring again to FIG. 3, exemplary first, second, and third mortar lines 87, 88, 89 are indicated. In step 102, points are selected from first mortar line 87 to correspond with where claws 12 will be set in step 106. Third mortar line 89 is directly above failing lintel 78 and this is where shims may be added in step 114. Second mortar line 88 is preferably two feet above first mortar line 87.

Although the present invention has been described in considerable detail with reference to certain preferred versions thereof, other versions would be readily apparent to those of ordinary skill in the art. Therefore, the spirit and scope of the description should not be limited to the description of the preferred versions contained herein.

We claim:

1. A lintel support comprising:

a flat body with a top, a bottom, a height extending between said top and said bottom, and a claw side and a non-claw side;

at least one claw extending perpendicularly from said top of said claw side of said body;

a bracket extending perpendicularly from said bottom of said claw side of said body, wherein said at least one claw comprises:

a center claw disposed directly over said bracket;

a right claw to the right of said center claw; and a left claw to the left of said center claw;

a center claw reinforcement extending substantially between said bottom of said body and said center claw;

a right claw reinforcement extending between said center claw reinforcement and said right claw; and a left claw reinforcement extending between said center claw reinforcement and said left claw;

wherein each of said center, right, and left claw reinforcements is a brace extending perpendicularly out from said non-claw side of said body.

2. The lintel support as claimed in claim 1, wherein said height of said body is between 15 and 20 inches.

3. The lintel support as claimed in claim 1, wherein said bracket comprises bracket right and left sides and bracket supports extending between said bracket right and left sides and said body.

4. The lintel support as claimed in claim 1, further comprising at least one claw reinforcement extending substantially between said bottom of said body and said at least one claw, and wherein each of said at least one claw reinforcements is a brace extending perpendicularly out from said body.

5. A masonry support kit comprising:

at least two lintel supports, wherein each of said at least two lintel supports comprises:

a flat body with a top, a bottom, a height extending between said top and said bottom, and a claw side and a non-claw side, wherein said bottom comprises a bracket width;

at least one claw extending perpendicularly from said top of said claw side of said body; and a bracket extending perpendicularly from said bottom of said claw side of said body, wherein said bracket comprises a bracket hole; and wherein said at least one claw comprises:

a center claw disposed directly over said bracket;

a right claw to the right of said center claw; and a left claw to the left of said center claw; and wherein:

said bottom of said body comprises a bracket width;

said top of said body comprises a claw width extending across said right center, and left claws;

said bracket width is less than said claw width; and said body further comprises a right angled side extending between said bracket and said right claw and a left angled side extending between said bracket and said left claw.

6. The masonry support kit as claimed in claim 5, further comprising:

a spreader comprising:

a spreader length;

a spreader depth;

a plurality of spreader holes disposed along said spreader length, wherein a diameter of said spreader holes is less than said bracket width of each of said at least two lintel supports; and means for holding said bracket holes of said at least two lintel supports in place relative to at least two of said plurality of spreader holes of said spreader.

7. The masonry support kit as claimed in claim 5, further comprising a support beam.

8. The masonry support kit as claimed in claim 5, further comprising a jack lift.

9. A method for supporting masonry using at least one lintel support, wherein the at least one lintel support comprises a body with a top, a bottom, a height extending between the top and the bottom, and a claw side and a non-claw side; at least one claw extending perpendicularly from the top of the claw side of the body; and a bracket extending perpendicularly from the bottom of the claw side of the body; wherein the at least one claw comprises a center claw disposed directly over the bracket, a right claw to the right of the center claw, and a left claw to the left of the center claw, wherein the bottom of the body comprises a bracket width; the top of the body comprises a claw width extending across the right, center, and left claws: the bracket width is less than the claw width; and the body further comprises a right angled side extending between the bracket and the right claw and a left angled side extending between the bracket and the left claw, wherein said method comprises the steps of:

selecting at least one point in a first mortar line above a failing lintel;

removing mortar from the at least one point in the first mortar line;

setting the at least one claw of the at least one lintel support into the at least one point with removed mortar such that the bracket of the at least one lintel support is disposed below the failing lintel;

disposing a support beam beneath the bracket of the lintel support;

disposing a jack lift beneath the support beam; and applying upward pressure from the jack lift.

10. The method as claimed in claim 9, further comprising the step of adding at least one shim above the failing lintel.

11. The method as claimed in claim 10, wherein said step of adding at least one shim above the failing lintel comprises the steps of:

removing mortar from a third mortar line, and introducing the at least one shim into the space created by the mortar removal from the third mortar line;

wherein the third mortar line is above the failing lintel and below the first mortar line.

12. The method as claimed in claim 11, further comprising the step of injecting caulk in front of the at least one shim.

13. The method as claimed in claim 10, wherein said step of adding at least one shim above the lintel comprises adding the at least one shim directly above the failing lintel.

14. The method as claimed in claim 10, further comprising the steps of:

removing mortar from at least one second mortar line above the first mortar line on either side of the at least one lintel support;

injecting masonry repair grout into a space created by the removed mortar from the at least one second mortar line, and inserting at least one helical embedment bar into the masonry repair grout.

15. The method as claimed in claim 9, further comprising the steps of:

removing mortar from at least one second mortar line above the first mortar line on either side of the lintel support:

injecting masonry repair grout into a space created by the removed mortar from the at least one second mortar line; and inserting at least one helical embedment bar into the masonry repair grout.

16. The method as claimed in claim 15, wherein said step of inserting at least one helical embedment bar into the masonry repair grout comprises:

inserting a first helical embedment bar into the masonry repair grout;

injecting additional masonry repair grout; and inserting a second helical embedment bar into the masonry grout.

17. The method as claimed in claim 15, further comprising the step of injecting caulk in front of the at least one helical embedment bar.

18. The method as claimed in claim 9, wherein:

said step of setting the at least one claw of at least one lintel support comprises setting the at least one claw of at least two lintel supports; and said method further comprises the steps of:

attaching the brackets of the at least two lintel supports to a spreader; and disposing the spreader between the at least two lintel supports and the support beam.

19. The method as claimed in claim 9, further comprising the steps of:

removing the failing lintel; and replacing the failing lintel with an undamaged lintel.

20. A lintel support comprising:

a flat body with a top, a bottom, a height extending between said top and said bottom, and a claw side and a non-claw side;

at least one claw extending perpendicularly from said top of said claw side of said body, wherein said at least one claw comprises:

a center claw;

a right claw to the right of said center claw; and a left claw to the left of said center claw; and a bracket extending perpendicularly from said bottom of said body;

wherein:

said bottom of said body comprises a bracket width;

said top of said body comprises a claw width extending across said right, center, and left claws;

said bracket width is less than said claw width; and said body further comprises a right angled side extending between said bracket and said right claw and a left angled side extending between said bracket and said left claw.

21. The lintel support as claimed in claim 20, wherein said height of said body is between 15 and 20 inches.

22. The lintel support as claimed in claim 20, wherein said bracket comprises bracket right and left sides and bracket supports extending between said bracket right and left sides and said body.

23. The lintel support as claimed in claim 20, further comprising at least one claw reinforcement extending substantially between said bottom of said body and said at least one claw, and wherein each of said at least one claw reinforcements is a brace extending perpendicularly out from said body.

* * * * *